US005816782A

United States Patent [19]

Nagayama et al.

[11] Patent Number: 5,816,782

[45] Date of Patent: Oct. 6, 1998

[54] MULTISTAGE POSITIVE-DISPLACEMENT VACUUM PUMP

[75] Inventors: Masami Nagayama, Fujisawa; Katsuaki Usui; Hiroaki Ogamino, both of Kawasaki, all of Japan

[73] Assignee: Ebara Corporation, Tokyo, Japan

[21] Appl. No.: 921,462

[22] Filed: Sep. 2, 1997

Related U.S. Application Data

[62] Division of Ser. No. 633,064, Apr. 16, 1996, abandoned.

[30] Foreign Application Priority Data

Apr. 19, 1995 [JP] Japan ..... 7-117928

[51] Int. Cl.[6] ..... F04B 35/04; F04C 25/02

[52] U.S. Cl. ..... 417/410.4; 417/420; 418/9

[58] Field of Search ..... 417/410.4, 420; 418/9, 10

[56] References Cited

U.S. PATENT DOCUMENTS

| | | | |
|---|---|---|---|
| 1,531,607 | 3/1925 | Green | 418/9 |
| 3,545,888 | 12/1970 | Wycliffe et al. | 417/310 |
| 3,677,664 | 7/1972 | Wycliffe et al. | 418/9 |

FOREIGN PATENT DOCUMENTS

| | | | |
|---|---|---|---|
| 1249171 | 3/1961 | France . | |
| 62-189388 | 8/1987 | Japan . | |
| 3-111690 | 5/1991 | Japan | 418/9 |
| 4-311696 | 11/1992 | Japan | 418/9 |
| 6-185483 | 7/1994 | Japan | 417/410.4 |
| 637942 | 5/1950 | United Kingdom . | |

OTHER PUBLICATIONS

European Patent Office Communication including European Seach Report, Annex to the European Search Report and translated Abstract for European Patent Application NO. 96105951.6; dated Aug. 26, 1996.

*Primary Examiner*—John J. Vrablik

*Attorney, Agent, or Firm*—Armstrong, Westerman, Hattori, McLeland & Naughton

[57] ABSTRACT

A multistage positive-displacement vacuum pump which is preferably used in the fabrication of semiconductor devices and can be operated from atmospheric pressure. The vacuum pump comprises a pump casing, a pump assembly housed in the pump casing and comprising a pair of pump rotors rotatable in synchronism with each other and arranged in multiple stages, and an intermediate pressure chamber provided between a preceding stage and a subsequent stage in the pump casing. The shaft portions of the pump rotors located between the preceding and subsequent stages are located in the intermediate pressure chamber.

1 Claim, 9 Drawing Sheets

MULTISTAGE POSITIVE-DISPLACEMENT VACUUM PUMP

This is a divisional of application Ser. No. 08/633,064 filed Apr. 16, 1996, abandoned.

BACKGROUND OF THE INVENTION

1. Field of the Invention

The present invention relates to a vacuum pump, and more particularly to a multistage positive-displacement vacuum pump which is preferably used in the fabrication of semiconductor devices and can be operated from atmospheric pressure.

2. Description of the Related Art

There has heretofore been known a vacuum pump called a Roots pump which has a pair of lobe-shaped pump rotors to rotate synchronously in opposite directions for exhausting a gas from a space that is to be maintained at subatmospheric pressure. The pump rotors are rotatably housed in a casing for rotation in the opposite directions. The pump rotors are kept out of contact with each other with a small gap therebetween, and the pump rotors and inner wall surface of the casing are also kept out of contact with one another with a small gap therebetween. One type of such a Roots pump has pump rotors arranged in multiple stages for developing a pressure of about $10^{-3}$ Torr at a suction port with the atmospheric pressure at a discharge port.

FIG. 8 shows a conventional Roots vacuum pump which has pump rotors arranged in multiple stages. FIG. 8 shows the relationship between a pump casing and a Roots rotor. FIG. 9 is a cross-sectional view taken along line IX—IX of FIG. 8. As shown in FIGS. 8 and 9, the vacuum pump has a pair of Roots rotors 21 as pump rotors rotatably housed in a pump casing 22. The pump casing 22 has cylindrical walls 22*w* each provided between stages, i.e. a preceding stage and a subsequent stage.

In FIGS. 8 and 9, the pressure at the suction port of the preceding stage is represented by $P_1$, and the pressure at the discharge port of the preceding stage is represented by $P_2$. Further, the pressure at the suction port of the subsequent stage is represented by $P_2$, and the pressure at the discharge port of the subsequent stage is represented by $P_3$.

In the conventional vacuum pump, as shown in FIG. 8, three pressures $P_1$, $P_2$ and $P_3$ are formed around a rotor shaft between a preceding stage and a subsequent stage. Therefore, the following six gas flows are formed around the rotor shaft.

$P_1 \rightarrow P_2$
$P_1 \leftarrow P_2$
$P_2 \rightarrow P_3$
$P_2 \leftarrow P_3$
$P_1 \rightarrow P_3$
$P_1 \leftarrow P_3$ In the conventional vacuum pump, the above gas flows decrease a pump efficiency.

SUMMARY OF THE INVENTION

It is therefore an object of the present invention to provide a multistage positive-displacement vacuum pump which can improve a pump efficiency or performance by reducing gas flows of $P_1 \rightarrow P_3$ and $P_1 \leftarrow P_3$ caused by the largest pressure difference in six gas flows formed between a preceding stage and a subsequent stage.

According to the present invention, there is provided a multistage positive-displacement vacuum pump comprising:

a pump casing; a pump assembly housed in the pump casing and comprising a pair of pump rotors rotatable in synchronism with each other and arranged in multiple stages; and an intermediate pressure chamber between a preceding stage and a subsequent stage in the pump casing, shaft portions of the pump rotors located between the preceding and subsequent stages being located in the intermediate pressure chamber.

According to the present invention, an intermediate pressure chamber is provided between the preceding and subsequent stages, and a cylindrical wall is not formed between the preceding and subsequent stages. Therefore, the rotor shaft portions located between the preceding and subsequent stages are enclosed by gas having a pressure after compressed by the preceding stage and before compressed by the subsequent stage, thus gas flows caused by the largest pressure difference between the preceding and subsequent stages can be reduced and the degree of vacuum is enhanced. In the semiconductor manufacturing process, corrosion occurs in the interior of the vacuum pump and deposition of materials is generated in the interior of the vacuum pump due to process gases. However, in the present invention, since a large amount of nitrogen gas which is effective against the above corrosion and deposition can be used to dilute the process gases, the service life of the vacuum pump can be prolonged.

Further, according to the present invention, since the pump casing comprises the upper and lower casing members, they can be easily assembled and disassembled.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
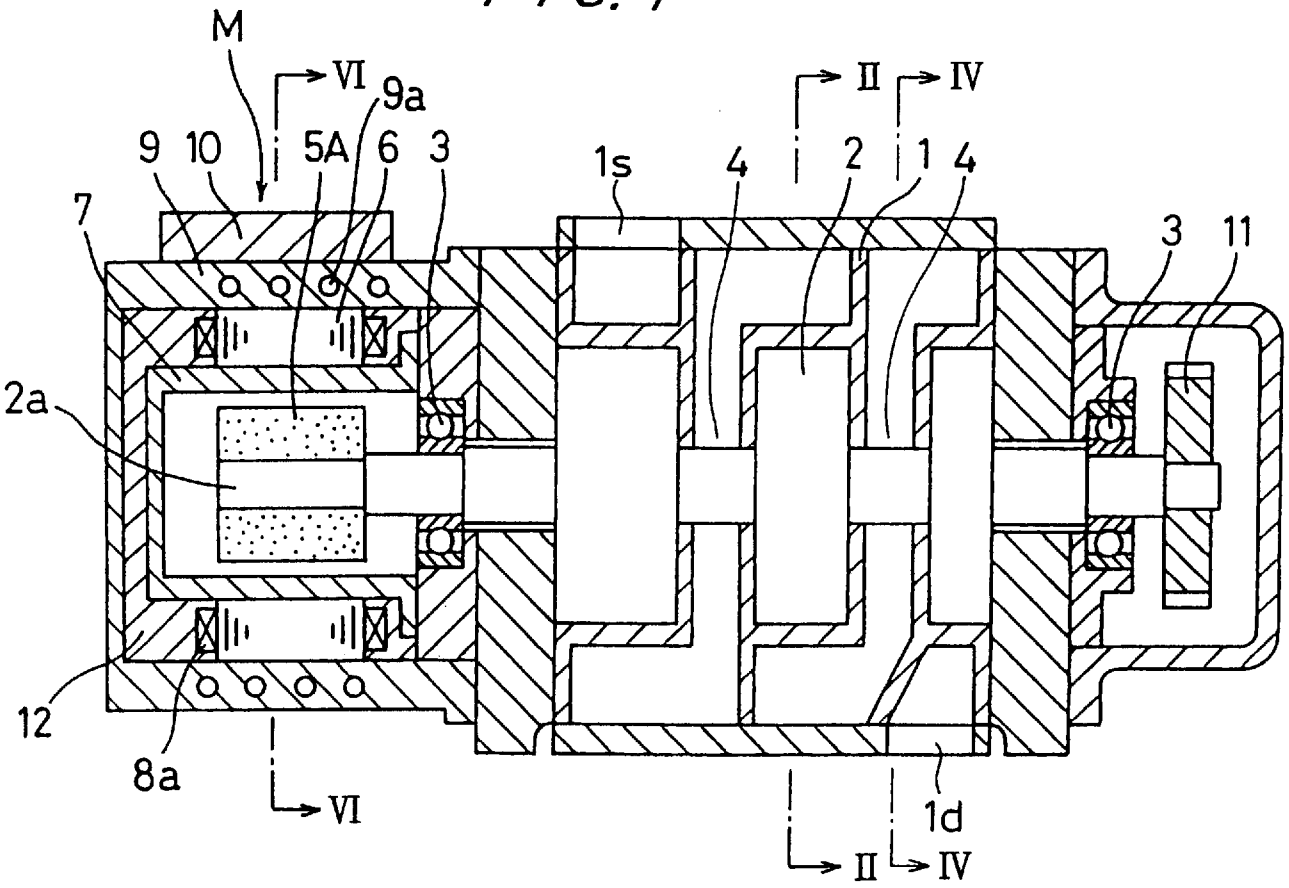
FIG. 1 is a longitudinal cross-sectional view of a multistage positive-displacement vacuum pump according to an embodiment of the present invention.
Figure 2:
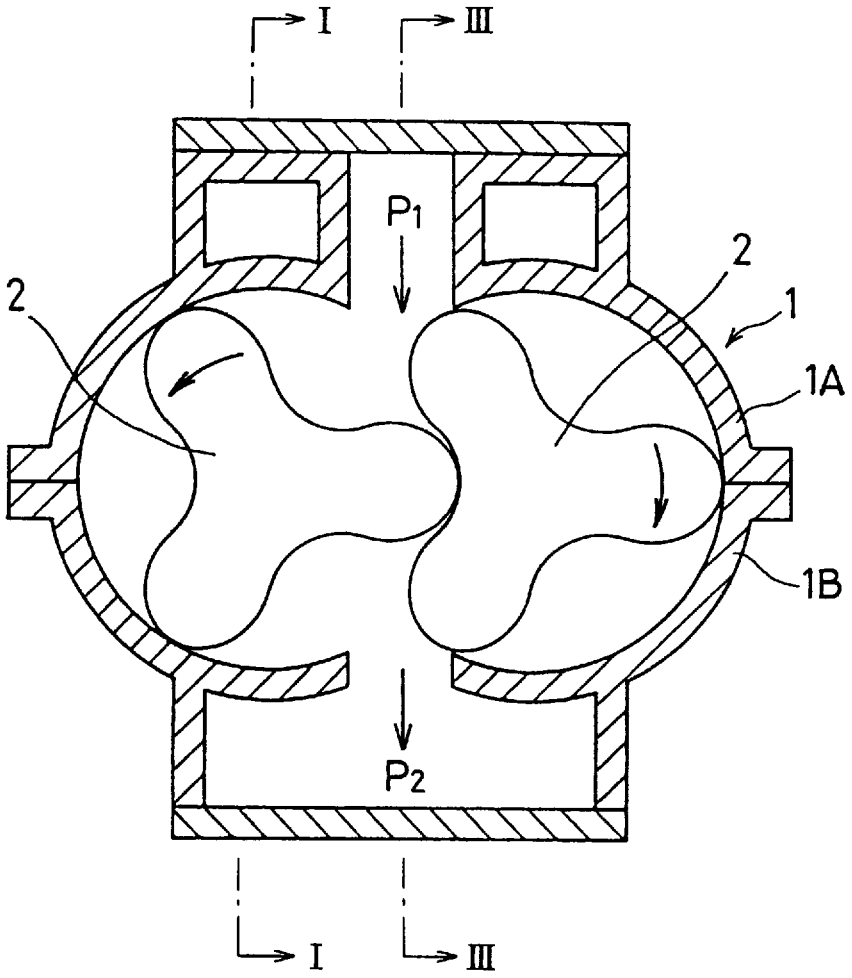
FIG. 2 is a cross-sectional view taken along line II—II of FIG. 1.

As shown in FIGS. 1 and 2, a multistage positive-displacement vacuum pump according to the present invention comprises a pump casing 1 and a pair of Roots rotors 2 as pump rotors rotatably housed in the pump casing 1. The Roots rotors 2 are arranged in multiple stages. The pump casing 1 has an elongated body having a suction side where a suction port 1*s* is located and a discharge side where a discharge port 1*d* is located. Each of the Roots rotors 2 is rotatably supported at its ends by bearings 3 mounted respectively on opposite axial ends of the pump casing 1. The Roots rotors 2 can be rotated about their own axes by a double-shaft brushless direct-current motor M mounted on one of the axial ends of the pump casing 1. The direct-current motor M is located at the suction side of the pump casing 1. The pump casing 1 comprises upper and lower casings 1A and 1B which are separable.

Figure 3:
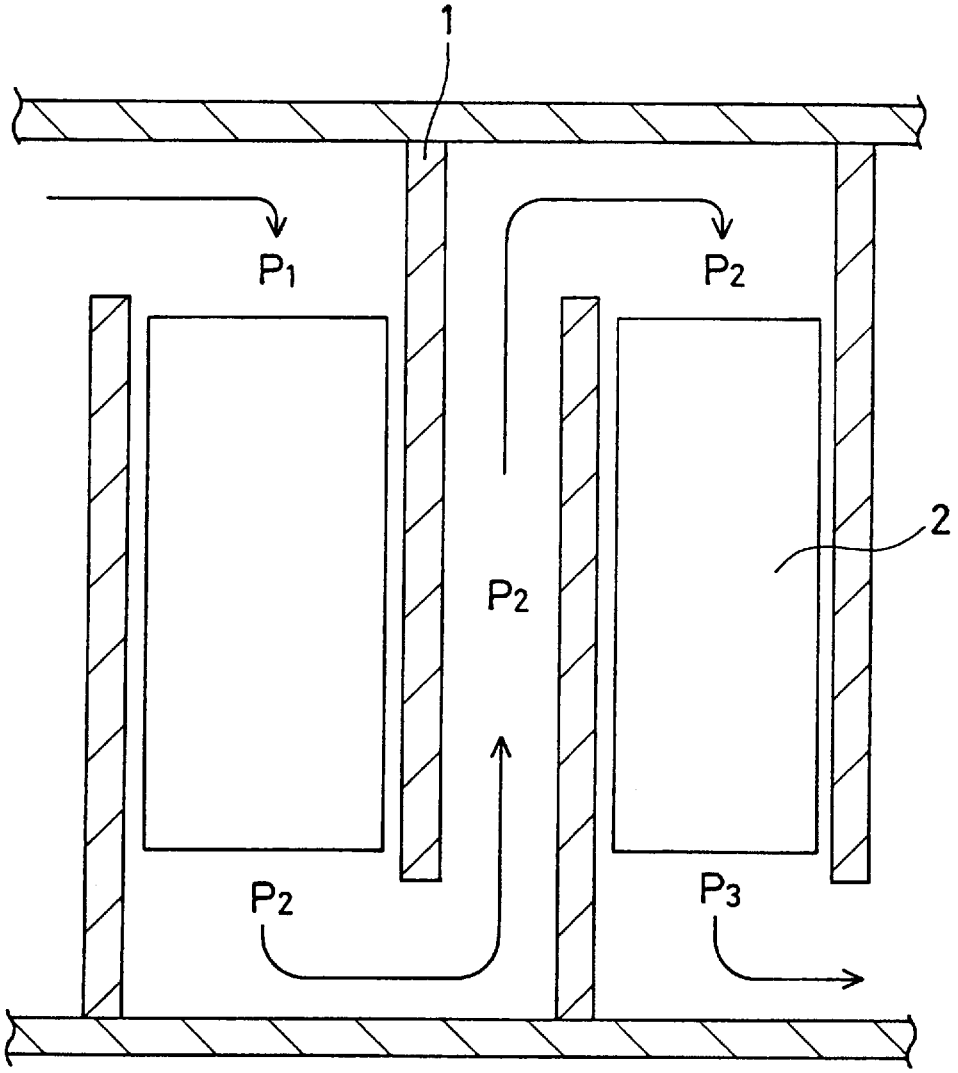
FIG. 3 is a cross-sectional view taken along line III—III of FIG. 2.
Figure 4:
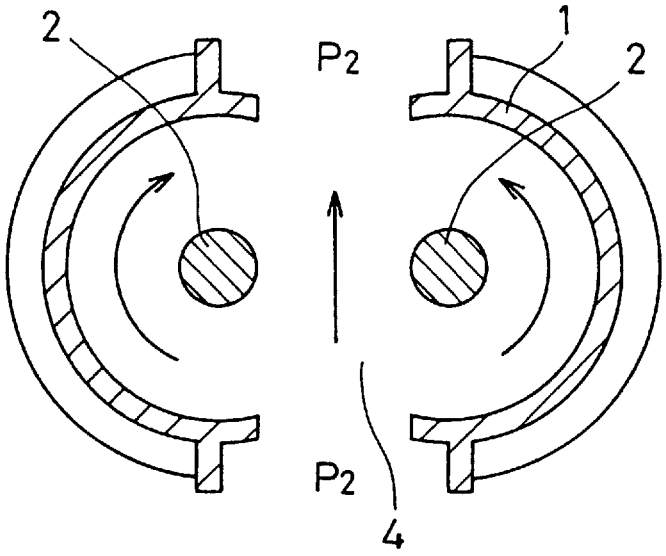
FIG. 4 is a cross-sectional view taken along line IV—IV of FIG. 1.

FIG. 3 is a cross-sectional view taken along line III—III of FIG. 2, and FIG. 4 is a cross-sectional view taken along line IV—IV of FIG. 1. FIGS. 2, 3 and 4 show the structure of the pump and pressures at various locations in the pump. That is, the pressure at the suction port of the preceding stage is represented by $P_1$, and the pressure at the discharge port of the preceding stage is represented by $P_2$. Further, the pressure at the suction port of the subsequent stage is represented by $P_2$, and the pressure at the discharge port of the subsequent stage is represented by $P_3$.

Figure 5:
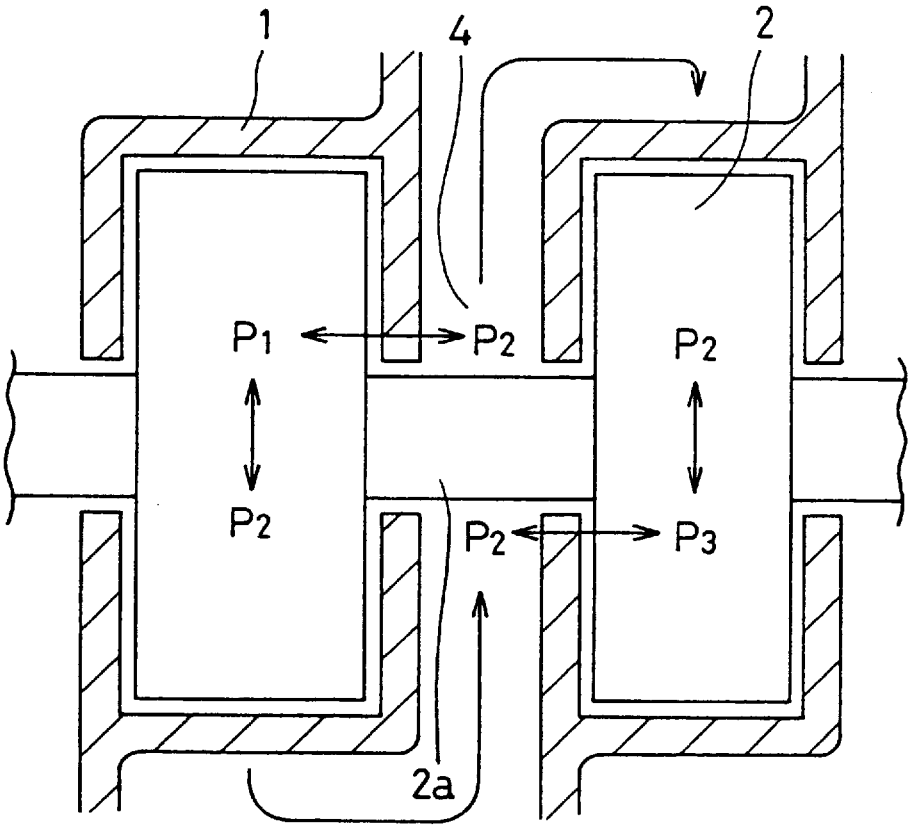
FIG. 5 is an enlarged cross-sectional view of FIG. 1.

FIG. 5 shows the relationship between the pump casing 1 and the Roots rotors 2. As shown in FIG. 5, the pump casing 1 has intermediate pressure chambers 4 each provided between a preceding stage and a subsequent stage so that rotor shaft portions 2*a* of the Roots rotors 2 located between the preceding and subsequent stages are enclosed by a gas having a pressure of $P_2$. The pressure of $P_2$ is a pressure after compressed by the preceding stage and before compressed by the subsequent stage. In this embodiment, there are provided two intermediate pressure chambers 4 which are located between first and second stages and between second and third stages as shown in FIG. 1. A cylindrical wall is not provided between the preceding and subsequent stages. Therefore, gas flows $P_1 \rightarrow P_2$, $P_1 \leftarrow P_2$, $P_2 \rightarrow P_3$ and $P_2 \leftarrow P_3$ are formed, but gas flows $P_1 \rightarrow P_3$ and $P_1 \leftarrow P_3$ which are caused by the largest pressure difference are greatly reduced, compared with the conventional vacuum pump. Thus, the compression ratio of each stage in the vacuum pump is greatly improved, and the pump efficiency or performance is increased.

Figure 6:
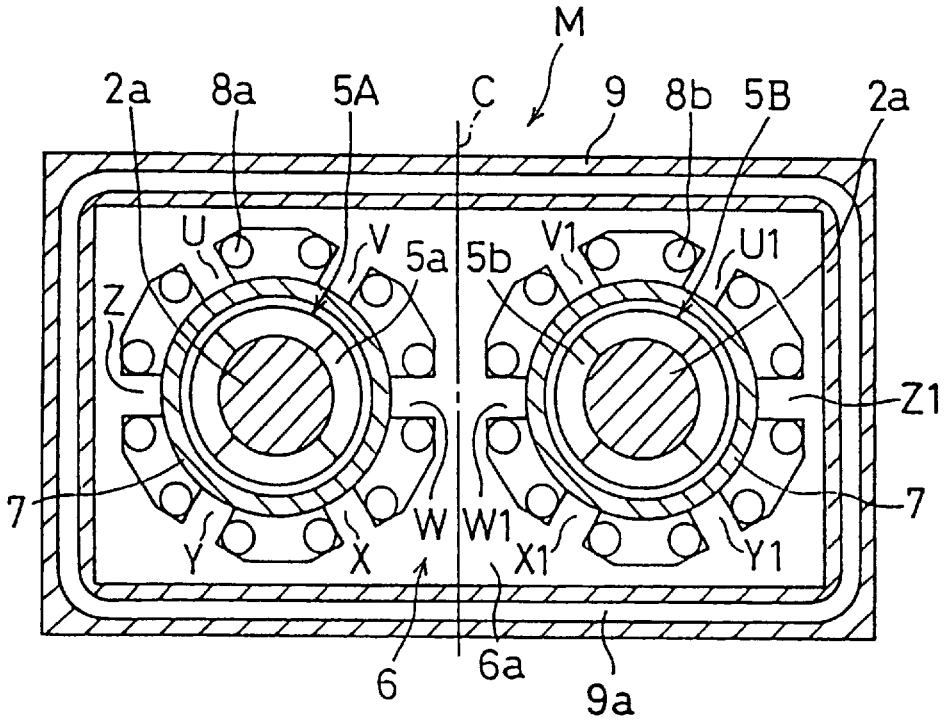
FIG. 6 is a cross-sectional view taken along line VI—VI of FIG. 1.

FIG. 6 shows a structural detail of the double-shaft brushless direct-current motor M. As shown in FIGS. 1 and 6, the double-shaft brushless direct-current motor M have two motor rotors 5A, 5B fixedly mounted on respective ends 2*a* of the shafts of the Roots rotors 2. The motor rotors 5A, 5B are located at the suction side of the vacuum pump. The motor rotors 5A, 5B comprise respective sets of 2n (n is an integer) permanent magnets 5*a*, 5*b* mounted respectively on the shaft ends 2*a* at equal circumferential intervals for generating radial magnetic fluxes.

As shown in FIGS. 1 and 6, the double-shaft brushless direct-current motor M has a pair of cylindrical cans 7 made of a corrosion-resistant material or synthetic resin disposed around the respective motor rotors 5A, 5B, and a motor stator 6 disposed around outer circumferential surfaces of the cans 7. The cans 7, which serve as vacuum containers for developing a vacuum therein, cover outer circumferential surfaces and axial end surfaces of the motor rotors 5A, 5B in spaced relation thereto, thus sealing a pump assembly of the vacuum pump which includes the Roots rotors 2. That is, vacuum is developed inside the cans 7. The inner surfaces of the cans 7 and the outer surfaces of the motor rotors 5A, 5B are black in color.

The motor stator 6 is housed in a water-cooled motor frame 9 attached to the pump casing 1 and having a water jacket 9*a*. The motor stator 6 comprises a motor stator core 6*a* disposed in the water-cooled motor frame 9 and comprising laminated sheets of silicon steel, and a pair of sets of coils 8*a*, 8*b* supported in the motor stator core 6*a* in surrounding relation to the cans 7.

As shown in FIG. 6, the motor stator core 6*a* has a first group of six magnetic pole teeth U, V, W, X, Y, Z extending radially inwardly at circumferentially equal intervals, and a second group of six magnetic pole teeth U1, V1, W1, X1, Y1, Z1 extending radially inwardly at circumferentially equal intervals. The coils 8*a* are mounted respectively on the magnetic pole teeth U, V, W, X, Y, Z, and the coils 8*b* are mounted respectively on the magnetic pole teeth U1, V1, W1, X1, Y1, Z1. The coils 8*a*, 8*b* thus mounted on the respective magnetic pole teeth are symmetrically arranged with respect to a central plane C lying intermediate between the motor rotors 5A, 5B, and wound in opposite directions such that they provide magnetic poles of opposite polarities. The water-cooled motor frame 9 houses therein a molded body 12 made of rubber, synthetic resin, or the like which is held in intimate contact therewith and encases the motor stator core 9, the coils 8*a*, 8*b*, and the cans 7.

As shown in FIG. 1, a motor driver 10 is fixedly mounted on an outer circumferential surface of the motor frame 9. The motor driver 10 has a driver circuit (not shown) electrically connected to the coils 8*a*, 8*b* for energizing the double-shaft brushless direct-current motor M to actuate the vacuum pump.

Two timing gears 11 (one shown in FIG. 1) are fixedly mounted on respective ends of the shafts of the Roots rotors 2 remotely from the double-shaft brushless direct-current motor M. The timing gears 11 serve to prevent the Roots rotors 2 from rotating out of synchronism with each other under accidental disturbing forces.

Operation of the vacuum pump will be described below with reference to FIGS. 6 and 7A–7D.

When the coils 8*a*, 8*b* of the double-shaft brushless direct-current motor M are energized by the motor driver 10, they develop a spatial moving magnetic field in the motor stator core 6*a* for rotating the motor rotors 5A, 5B in opposite directions.

Magnetic fields generated by the permanent magnets 5*a*, 5*b* of the motor rotors 5A, 5B pass through a closed magnetic path that is formed between the motor rotors 5A, 5B by the motor stator core 6*a*. The motor rotors 5A, 5B are rotated in the opposite directions synchronously with each other due to a magnetic coupling action between unlike magnetic poles thereof.

When the motor rotors 5A, 5B are synchronously rotated in the opposite directions, the Roots rotors 2 are also synchronously rotated in the opposite directions because the Roots rotors 2 and the motor rotors 5A, 5B are coaxially provided.

Figure 7A:
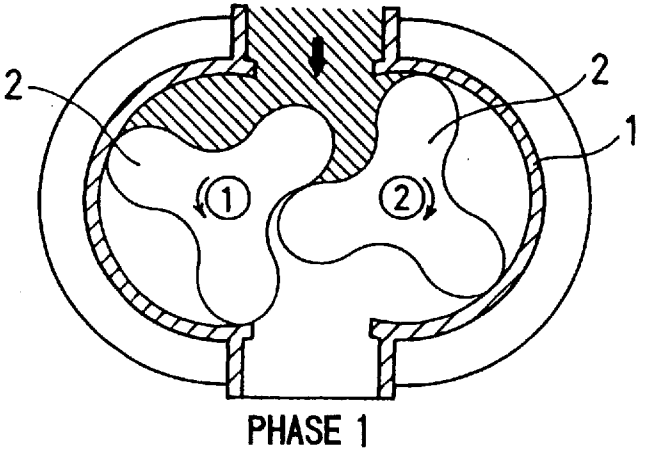
FIGS. 7A, 7B, 7C, and 7D are cross-sectional views illustrative of the manner in which Roots rotors of the vacuum pump shown in FIG. 1 operate.
Figure 7B:
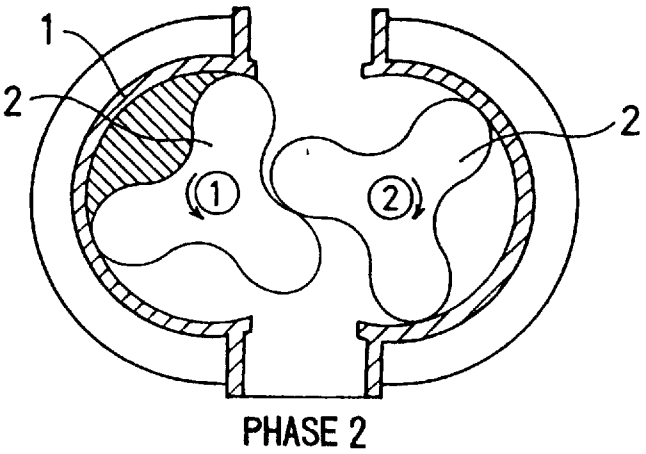
Figure 7C:
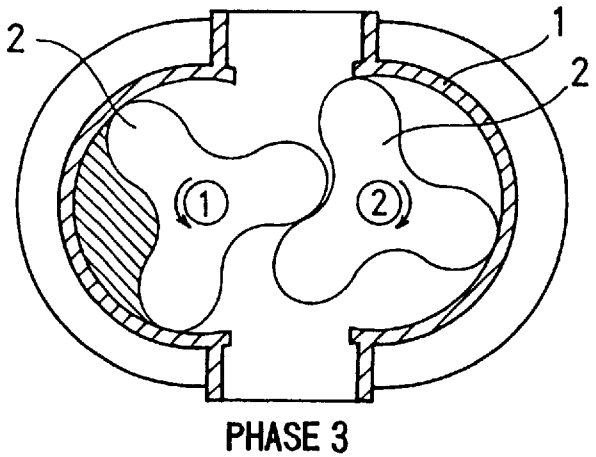
Figure 7D:
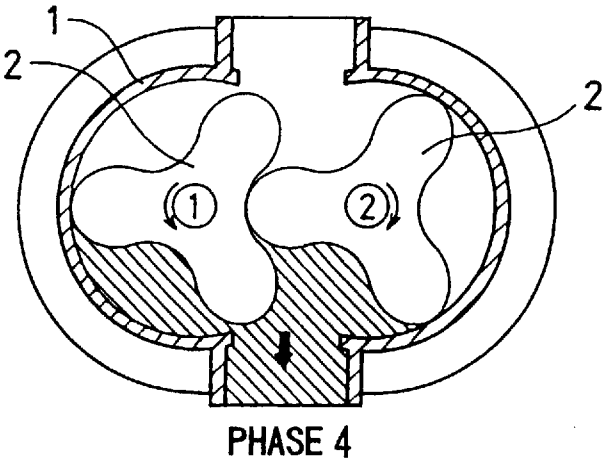
Figure 8:
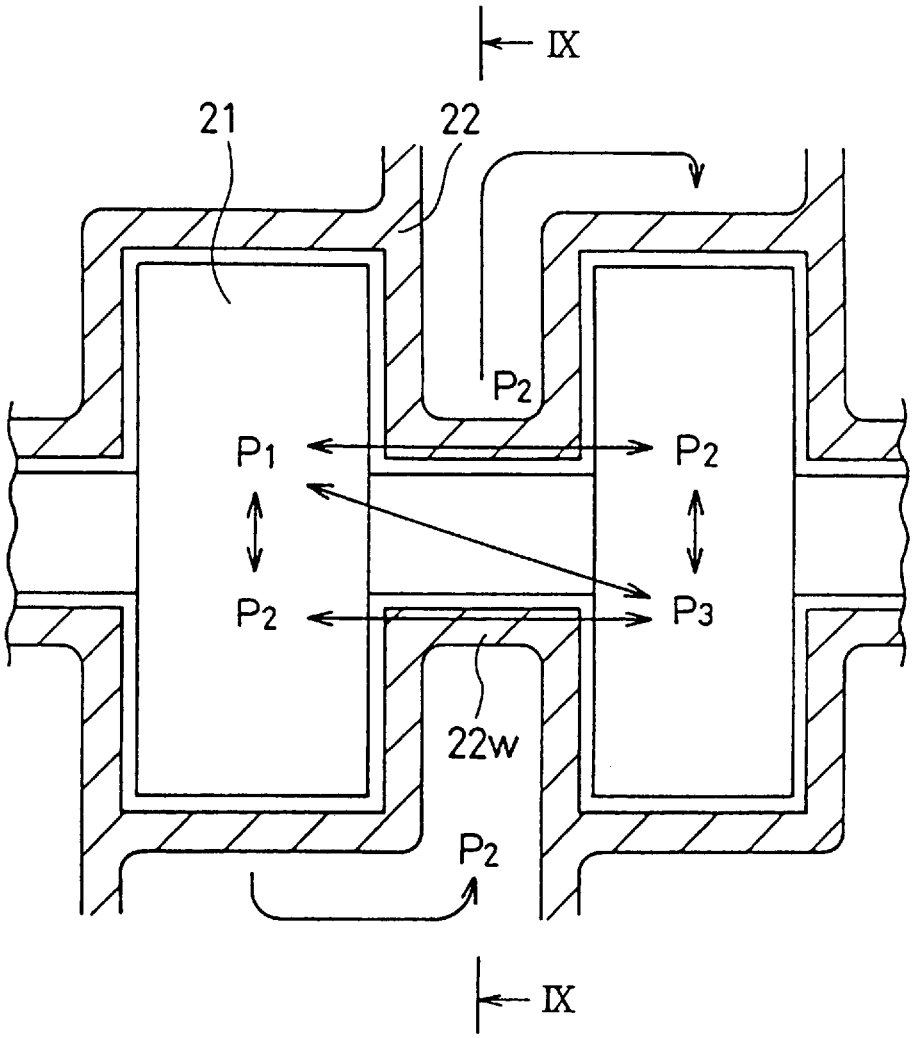
FIG. 8 PRIOR ART
FIG. 8 is a cross-sectional view of a conventional vacuum pump.
Figure 9:
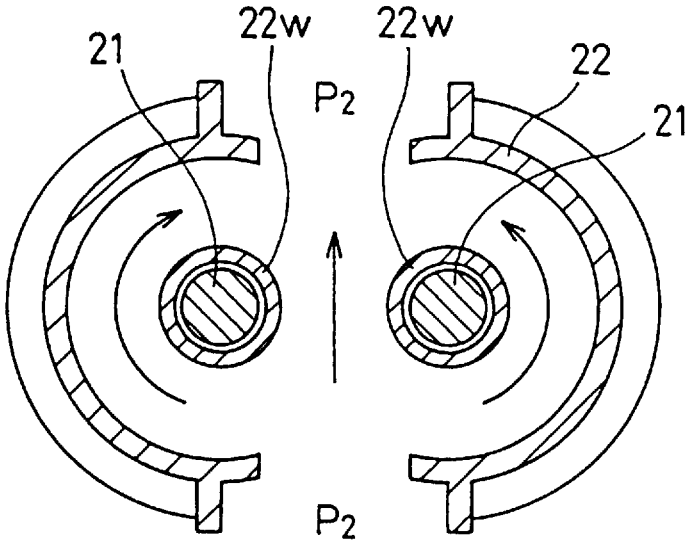
FIG. 9 PRIOR ART
FIG. 9 is a cross-sectional view taken along line IX—IX of FIG. 8.

FIGS. 7A–7D illustrate schematically the manner in which the Roots rotors 2 operate in a certain stage such as a first stage. As shown in FIGS. 7A–7B, the Roots rotors 2 are rotated in the opposite directions out of contact with each other with slight gaps left between the Roots rotors 2 and the inner circumferential surface of the pump casing 1 and also between the Roots rotors 2 themselves. As the Roots rotors 2 are rotated successively from Phase 1 (FIG. 7A) to Phase 4 (FIG. 7D), a gas drawn from a suction side is confined between the Roots rotors 2 and the pump casing 1 and transferred to a discharge side. Each of the Roots rotors 2 is shown as a three-lobe-shaped Roots rotor. Since the three-lobe-shaped Roots rotor has three valleys between the lobes, the gas is discharged six times in one revolution. The gas discharged from a certain stage such as the first stage is introduced into the next stage such as a second stage.

In the present invention, the pump casing 1 has the intermediate pressure chambers 4 each provided between a preceding stage and a subsequent stage so that the rotor shaft portions 2*a* located between the preceding and subsequent stages are enclosed by a gas having a pressure of $P_2$. The pressure of $P_2$ is a pressure after compressed by the preceding stage and before compressed by the subsequent stage. A cylindrical wall is not provided between the preceding and subsequent stages. Therefore, gas flows $P_1 \rightarrow P_2$, $P_1 \leftarrow P_2$, $P_2 \rightarrow P_3$ and $P_2 \leftarrow P_3$ are formed, but gas flows $P_1 \rightarrow P_3$ and $P_1 \leftarrow P_3$ which are caused by the largest pressure difference are greatly reduced, compared with the conventional vacuum pump. Thus, the compression ratio of each stage in the vacuum pump is greatly improved, and the pump efficiency or performance is increased, and the degree of vacuum is enhanced.

As is apparent from the above description, according to the present invention, the degree of vacuum is enhanced by providing the intermediate pressure chamber between the preceding and subsequent stages.

In the semiconductor manufacturing process, corrosion occurs in the interior of the vacuum pump and deposition of materials is generated in the interior of the vacuum pump due to process gases. However, in the present invention, since a large amount of nitrogen gas which is effective against the above corrosion and deposition can be used to dilute the process gases, the service life of the vacuum pump can be prolonged.

Further, according to the present invention, since the pump casing comprises the upper and lower casing members, they can be easily assembled and disassembled.

In the embodiment described above, a double-shaft brushless direct-current motor has been shown and described as being embodied for a motor for driving Roots rotors. However, a normal motor such as a squirrel-cage induction motor can be used.

Although a certain preferred embodiment of the present invention have been shown and described in detail, it should be understood that various changes and modifications may be made therein without departing from the scope of the appended claims.

What is claimed is:

1. A multistage positive-displacement vacuum pump comprising:

a pump casing;

a pump assembly housed in said pump casing and comprising a pair of pump rotors rotatable in synchronism with each other and arranged in multiple stages; and an intermediate pressure chamber means for enhancing vacuum in said pump by decreasing gas flows between a pressure at a suction port of said preceding stage and a pressure at a discharge port of said subsequent stage, said intermediate pressure chamber means being provided between a preceding stage and a subsequent stage in said pump casing and said intermediate pressure chamber means not being enclosed within a cylindrical wall connecting said preceding stage to said subsequent stage, and shaft portions of said pump rotors located between said preceding stage and said subsequent stage being located in said intermediate pressure chamber means; and means for driving said pump rotors to actuate said pump, wherein said driving means is a double-shafted brushless direct-current motor.

* * * * *